US011964195B2

(12) United States Patent
Kirt

(10) Patent No.: US 11,964,195 B2
(45) Date of Patent: Apr. 23, 2024

(54) TRAINING BAT

(71) Applicant: LeftySwag, LLC, Milwaukee, WI (US)

(72) Inventor: Jeffrey S. Kirt, Milwaukee, WI (US)

(73) Assignee: LeftySwag, LLC, Milwaukee, WI (US)

( * ) Notice: Subject to any disclaimer, the term of this patent is extended or adjusted under 35 U.S.C. 154(b) by 320 days.

(21) Appl. No.: 17/084,360

(22) Filed: Oct. 29, 2020

(65) Prior Publication Data

US 2021/0129000 A1 May 6, 2021

Related U.S. Application Data

(60) Provisional application No. 62/928,758, filed on Oct. 31, 2019.

(51) Int. Cl.
*A63B 69/00* (2006.01)
*A63B 59/58* (2015.01)

(52) U.S. Cl.
CPC ..... *A63B 69/0002* (2013.01); *A63B 59/58* (2015.10); *A63B 2069/0008* (2013.01); *A63B 2209/02* (2013.01)

(58) Field of Classification Search
CPC ..... A63B 69/0002; A63B 59/58; A63B 59/50; A63B 2059/581; A63B 2209/02; A63B 2069/0008
See application file for complete search history.

(56) References Cited

U.S. PATENT DOCUMENTS

| | | | | |
|---|---|---|---|---|
| 7,377,866 | B2 * | 5/2008 | Van Nguyen | A63B 60/54 473/566 |
| 9,186,562 | B1 * | 11/2015 | Mathur | A63B 59/58 |
| 2012/0108369 | A1 * | 5/2012 | Epling | A63B 59/51 473/564 |
| 2014/0206483 | A1 * | 7/2014 | Goodwin | A63B 60/42 473/564 |
| 2017/0354854 | A1 * | 12/2017 | Lanyon | A63B 59/56 |
| 2018/0345102 | A1 * | 12/2018 | Kikuchi | A63B 59/51 |
| 2019/0022483 | A1 * | 1/2019 | Chauvin | A63B 59/50 |
| 2019/0143185 | A1 * | 5/2019 | Hunt | A63B 60/08 473/564 |

OTHER PUBLICATIONS

The International Search Report and Written Opinion for the International Application No. PCT/US20/058388 application dated Feb. 2, 2021.
International Preliminary Report on Patentability dated May 12, 2022 in International Application No. PCT/US2020/058388, 7 pages.

* cited by examiner

*Primary Examiner* — Raleigh W Chiu
(74) *Attorney, Agent, or Firm* — Haverstock & Owens, A Law Corporation

(57) ABSTRACT

A bat comprises a handle section, a barrel section and a tapered section between the handle section and the barrel section. In some embodiments, the tapered section comprises discrete zones that increase in diameter from the handle section to the barrel section of the bat. In some embodiments, the tapered section comprises six discrete zones. In some embodiments, the discrete zones are one-inch in length.

13 Claims, 2 Drawing Sheets

TRAINING BAT

RELATED APPLICATIONS

This Patent Application claims priority under 35 U.S.C. 119(e) of the U.S. provisional patent application, Application No. 62/928,758, filed on Oct. 31, 2019, and entitled "TRAINING BAT," which is also hereby incorporated by reference in its entirety.

FIELD OF THE INVENTION

The present invention relates to sports and sports training systems and devices. More specifically, the present invention relates to a training bat able to be used with real baseballs and softballs.

BACKGROUND OF THE INVENTION

A thin or skinny training bat can help improve hand-eye coordination and bat speed for a user. A bat with a smaller barrel can help a baseball and softball player improve hand-eye coordination, hand strength, and overall bat control. However, often a smaller barrel bat is only usable with a golf ball, a wiffle ball or other light-weight training aid and not a real or actual baseball or softball.

SUMMARY OF THE INVENTION

Embodiments are directed to a bat comprising a handle section, a barrel section and a tapered section between the handle section and the barrel section. In some embodiments, the tapered section comprises discrete zones that increase in diameter from the handle section to the barrel section of the bat. In some embodiments, the tapered section comprises six discrete zones. In some embodiments, the discrete zones are one-inch in length.

In a first aspect, a sports training device comprises a body comprising a handle section, a barrel section and a taper section between the handle section and the barrel section, wherein the taper section tapers from a diameter of less than 2.61 inches at the barrel section to a diameter of 0.937 inches at the handle section. In some embodiments, the taper section tapers from a diameter of 1.50 inches at the barrel section to a diameter of 0.937 inches at the handle section. In further embodiments, the taper section tapers from a diameter of 1.75 inches at the barrel section to a diameter of 0.937 inches at the handle section. In some embodiments, the taper section is 6 inches in length. In some embodiments, the handle section and the barrel section are a same length. In further embodiments, the body comprises 150 g carbon fiber with 38% resin. In some embodiments, the training device is configured to hit standard size baseballs and softballs.

In a further aspect, a training system comprises a thin barrel bat configured to hit standard sized baseballs and softballs, the bat comprising a handle section, a barrel section, and a taper section between the handle section and the barrel section, wherein the taper section comprises a plurality of discrete zones that increase in diameter from the handle section to the barrel section of the bat. In some embodiments, the barrel section comprises a diameter of 1.5 inches and the handle section comprises a diameter of 0.937 inches. In further embodiments, the barrel section comprises a diameter of 1.75 inches and the handle section comprises a diameter of 0.937 inches. In some embodiments, the taper section is 6 inches in length. In some embodiments, the handle section and the barrel section are a same length. In some embodiments, the body comprises 150 g carbon fiber with 38% resin.

In another aspect, a method of manufacturing a sports training device comprises forming a bat body comprising forming a handle section with a diameter of 0.937 inches, forming a barrel section comprising a diameter of less than 2.61 inches; and forming a taper section between the handle section and the barrel section, wherein the tapered section is formed such that the taper section tapers from the diameter of less than 2.61 inches at the barrel section to the diameter of 0.937 inches at the handle section.

In some embodiments, the barrel section comprises a diameter of 1.5 inches and the handle section comprises a diameter of 0.937 inches. In further embodiments, the barrel section comprises a diameter of 1.75 inches and the handle section comprises a diameter of 0.937 inches. In some embodiments, the taper section is 6 inches in length. In some embodiments, the handle section and the barrel section are a same length. In further embodiments, the body comprises 150 g carbon fiber with 38% resin. In some embodiments, the sports training device is configured to hit standard size baseballs and softballs.

DETAILED DESCRIPTION OF THE EMBODIMENTS

Reference will now be made in detail to implementations of a sports training device for improving hand-eye coordination and bat control. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Embodiments of the presently claimed invention are directed to a bat comprising a handle section, a barrel section and a tapered section between the handle section and the barrel section. In some embodiments, the tapered section comprises discrete zones that increase in diameter from the handle section to the barrel section of the bat. In some embodiments, the tapered section comprises six discrete zones. In some embodiments, the discrete zones are one-inch in length.

A standard sized baseball bat for use with a real or actual baseball may have a barrel diameter of 2.625 inches to 2.75 inches for actual game play and/or practice. Typically a standard sized fastpitch and slowpitch bat is able to have a barrel diameter of 2.25 inches. In some embodiments, the training bat as described herein with a smaller barrel for improving hand-eye coordination and bat speed has a barrel diameter of 1.50 inches or less and is used with real baseballs and softballs to feel the impact of a real baseball or softball to improve hand-eye coordination and bat speed. Alternatively, in some embodiments, the training bat as described herein with a smaller barrel for improving hand-eye coordination and bat speed has a barrel diameter of 1.75 inches or less and is used with real baseballs and softballs to feel the impact of a real baseball or softball to improve hand-eye coordination and bat speed. Particularly, as described below, the handle section and the barrel section of the training bat are able to comprise any appropriately desired diameter.

Figure 1:
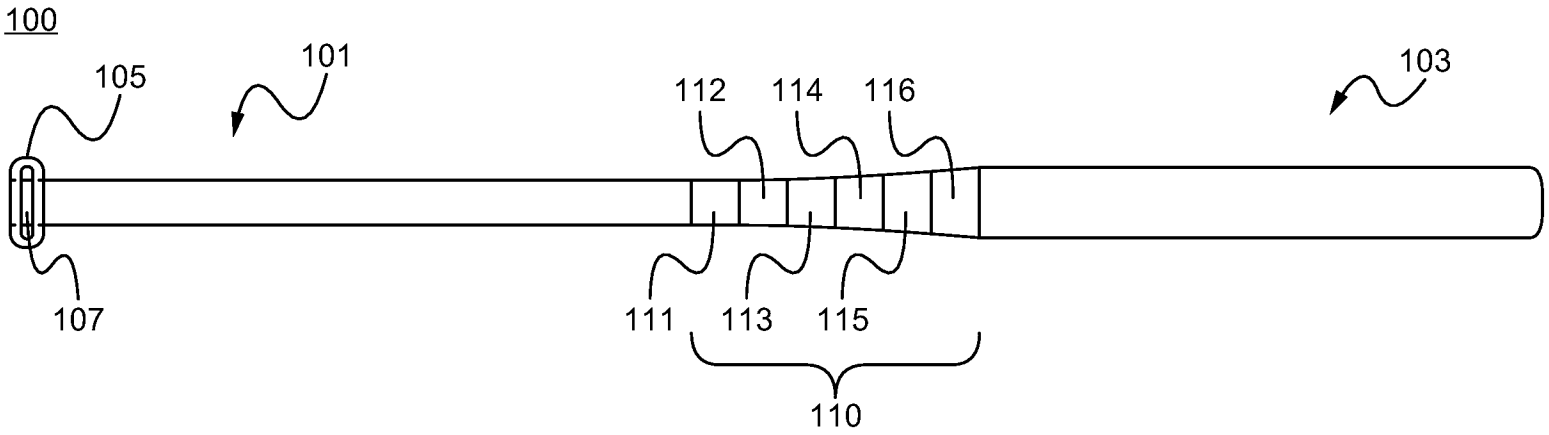
FIG. 1 illustrates a sports training device in accordance with some embodiments.

Referring now to FIG. 1, a sports training device is depicted therein. The sports training device 100 comprises a body comprising a handle section 101, a barrel section 103 and a taper section 110. In some embodiments the body comprises a knob 105 which connects to the body with a steel pin 107. For example, in some embodiments, such as shown in FIG. 1, the handle section 101 fits into the knob 105 and the pin 107 runs horizontally through the handle section 101 and the knob 105 for added security.

In some embodiments, the taper section comprises a diameter of 1.50 inches at the barrel section 103 and a diameter of 0.937 inches at the handle section 101. In some embodiments, the handle section 101 comprises a diameter of 0.937 inches and the barrel section 103 comprises a diameter of 1.50 inches. In some embodiments, the handle section 101 comprises a diameter of 0.937 inches and the barrel section 103 comprises a diameter of 1.75 inches. Particularly, the handle section 101 and the barrel section 103 are able to comprise any appropriately desired diameter. In some embodiments, the barrel section 103 comprises a skinny or thin barrel and is less than 2.61 inches and/or smaller than the size of game used baseball or softball bat. In some embodiments, the barrel section 103 and the handle section 101 are the same length. In this manner, the handle section 101 and the barrel section 103 are able to be easily manufactured and formed with a consistently sized taper section 110, which is the same size for each length of bat.

In some embodiments, the taper section 110 comprises a plurality of discrete sections, wherein the plurality of discrete sections each increase in diameter from the handle section 101 to the barrel section 103. In some embodiments, the plurality of discrete sections are each 1 inch in length. In some embodiments, the taper section 110 is 6 inches long. However, the taper section 110 is able to comprise any appropriately desired length. As shown within FIG. 1, in some embodiments, the discrete taper section 111 has a diameter of 1.0315 inches, the discrete taper section 112 has a diameter of 1.124 inches, the discrete taper section 113 has a diameter of 1.218 inches, the discrete taper section 114 has a diameter of 1.312 inches, the discrete taper section 115 has a diameter of 1.406 inches and the discrete taper section 116 has a diameter of 1.50 inches so that the taper section 110 uniformly tapers from the barrel section 103 to the handle section 105. However, the taper section 110 is able to comprise any appropriately desired length and comprise any appropriately desired number of discrete taper sections.

In some embodiments, the bat comprises 150 g carbon fiber with 38% resin. However, the body is able to be manufactured from any appropriately desired material. In some embodiments, the sports training device 100 is configured to hit standard sized and weighted baseballs and softballs.

Figure 2:
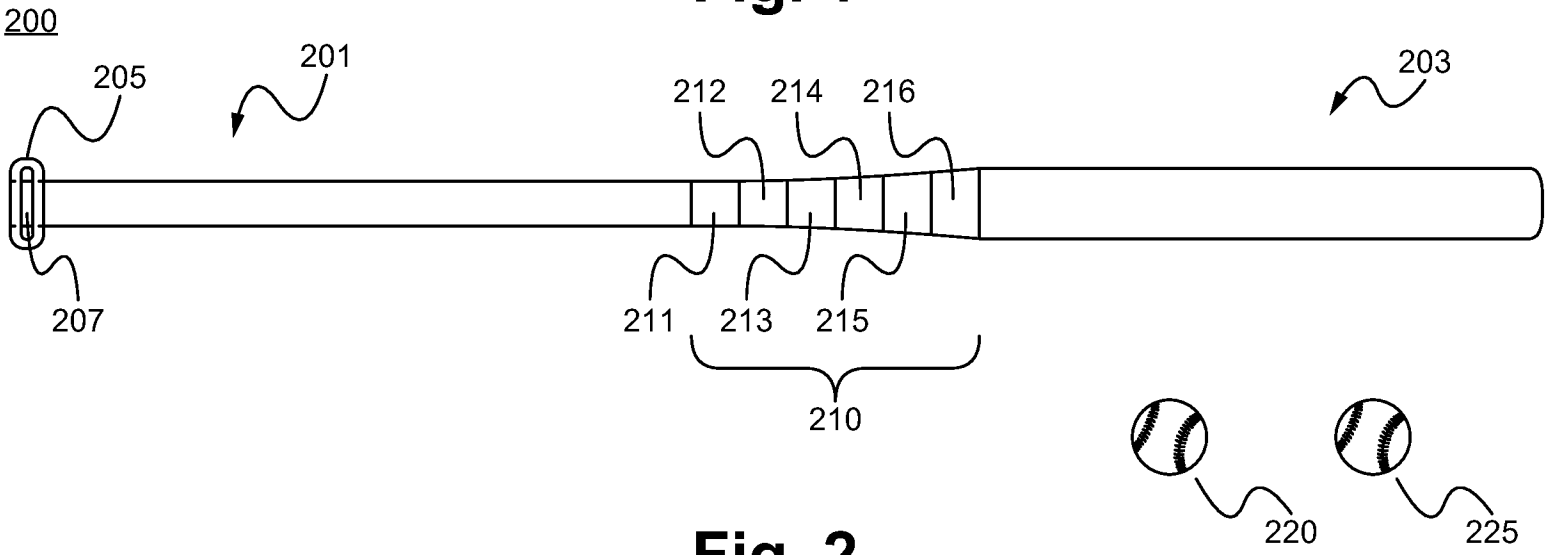
FIG. 2 illustrates a sports training system in accordance with some embodiments.

FIG. 2 illustrates a training system in accordance with some embodiments. As shown within FIG. 2, the system 200 comprises a body comprising a handle section 201, a barrel section 203 and a taper section 210. In some embodiments the body comprises a knob 205 which connects to the body with a steel pin 207. For example, as described above and as shown in FIG. 2, the handle section 201 fits into the knob 205 and the pin 207 runs horizontally through the handle section 201 and the knob 205 for added security.

In some embodiments, the taper section comprises a diameter of 1.50 inches at the barrel section 203 and a diameter of 0.937 inches at the handle section 201. In some embodiments, the handle section 201 comprises a diameter of 0.937 inches and the barrel section 203 comprises a diameter of 1.50 inches. In some embodiments, the handle section 201 comprises a diameter of 0.937 inches and the barrel section 203 comprises a diameter of 1.75 inches. In some embodiments, the tapered section 210 comprises a plurality of discrete zones that increase in diameter from the handle section 201 to the barrel section 205 of the body, such as describe in relation to the device 100, above.

For example, in some embodiments, the plurality of discrete sections are each 1 inch in length. In some embodiments, the taper section 210 is 6 inches long. However, the taper section 210 is able to comprise any appropriately desired length. In some embodiments, the discrete taper section 211 has a diameter of 1.0315 inches, the discrete taper section 212 has a diameter of 1.124 inches, the discrete taper section 213 has a diameter of 1.218 inches, the discrete taper section 214 has a diameter of 1.312 inches, the discrete taper section 215 has a diameter of 1.406 inches and the discrete taper section 216 has a diameter of 1.50 inches so that the taper section 210 uniformly tapers from the barrel section 203 to the handle section 205. In some embodiments, the barrel section 203 comprises a diameter of 1.75 inches. However, the taper section 210 is able to comprise any appropriately desired length and comprise any appropriately desired number of discrete taper sections.

As described above, in some embodiments, the taper section comprises a diameter of 1.50 inches at the barrel section 203 and a diameter of 0.937 inches at the handle section 201. In some embodiments, the handle section 201 comprises a diameter of 0.937 inches and the barrel section comprises a diameter of 1.50 inches. Particularly, the handle section 201 and the barrel section 203 are able to comprise any appropriately desired diameter. In some embodiments, the barrel section 203 comprises a skinny or thin barrel and is less than 2.61 inches and/or smaller than the size of game used baseball or softball bat. In some embodiments, the barrel section 203 and the handle section 201 are the same length. In this manner, the handle section 201 and the barrel section 203 are able to be easily manufactured and formed with a consistently sized taper section 210, which is the same size for each length of bat.

In some embodiments, the bat comprises 150 g carbon fiber with 38% resin. However, the body is able to be manufactured from any appropriately desired material. In some embodiments, the sports training system 200 is configured to be used with standard sized and weighted baseballs 220 and softballs 225. For example, in some embodiments, the body is configured to hit a baseball 220 that is 5-5.25 ounces and a softball 225 that is 11 inches or 12 inches in diameter.

Figure 3:
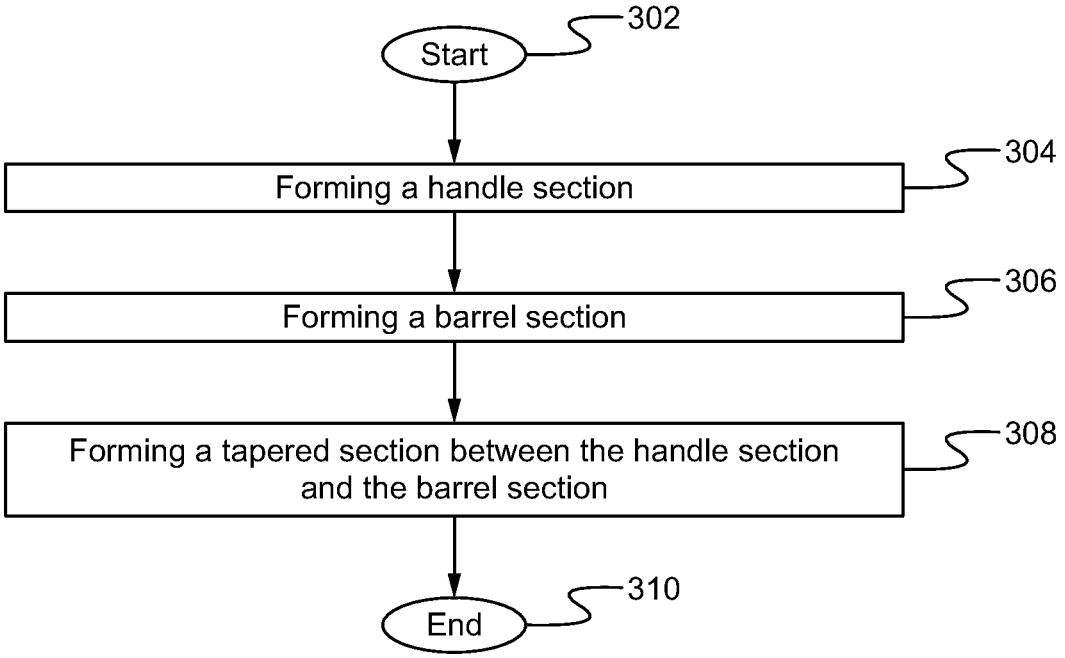
FIG. 3 illustrates a method of manufacturing a sports training device in accordance with some embodiments.

FIG. 3 illustrates a method of manufacturing a sports training device in accordance with some embodiments. The method of manufacturing a sports training device comprises forming a bat body. The method begins in the step 302. In the step 304, a handle section with a diameter of 0.937 inches is formed. In the step 306, a barrel section with a diameter of 1.50 inches is formed and in the step 308 a tapered section between the handle section and the barrel section is formed, wherein the tapered section is formed such that the tapered section increases in diameter from 0.937 inches at the handle section to 1.50 inches at the barrel section. As described above, in some embodiments, the tapered section 210 comprises a plurality of discrete zones that increase in diameter from the handle section 201 to the barrel section 205 of the body. The method ends in the step 310.

In operation, the training device and system as described herein enables a user to use a bat with a smaller barrel to improve hand-eye coordination and bat speed. Particularly, the structure of the body having a handle section, a barrel section and a taper section enables a user to still use a smaller barrel bat while using real baseballs and softballs and feel the impact of a real baseball or softball to improve hand-eye coordination and bat speed. As such, the training bat as described herein has many advantages.

The present invention has been described in terms of specific embodiments incorporating details to facilitate the understanding of the principles of construction and operation of the invention. As such, references, herein, to specific embodiments and details thereof are not intended to limit the scope of the claims appended hereto. It will be apparent to those skilled in the art that modifications can be made in the embodiments chosen for illustration without departing from the spirit and scope of the invention.

I claim:

1. A sports training device comprising:

a. a body comprising:

i. a handle section having a diameter of 0.937 inches;

ii. a barrel section having a diameter of less than 1.5 inches; and iii. a taper section between the handle section and the barrel section, the taper section having six discrete zones that each have a different maximum diameter, wherein the taper section tapers from a diameter of less than 1.50 inches at the barrel section to a diameter of 0.937 inches at the handle section, wherein the handle section and the barrel section are a same length.

2. The sports training device of claim 1, further comprising a knob, wherein an end of the handle section is coupled within the knob with a pin that runs through the knob and the end of the handle.

3. The sports training device of claim 1, wherein the body comprises 150 g carbon fiber with 38% resin.

4. The sports training device of claim 1, wherein the sports training device is configured to hit standard size baseballs and softballs.

5. A sports training system comprising:

a. a thin barrel bat configured to hit standard sized baseballs and softballs, the bat comprising:

i. a handle section having a diameter of 0.937 inches;

ii. a barrel section having a diameter of less than 1.5 inches; and iii. a taper section between the handle section and the barrel section, wherein the taper section increases in diameter from the handle section to the barrel section of the bat, wherein the handle section and the barrel section are a same length.

6. The sports training system of claim 5, wherein the taper section is 6 inches in length.

7. The sports training system of claim 5, further comprising a knob, wherein an end of the handle section is coupled within the knob with a pin that runs through the knob and the end of the handle.

8. The sports training system of claim 5, wherein the body comprises 150 g carbon fiber with 38% resin.

9. A method of manufacturing a sports training device comprising:

a. forming a bat body comprising i. forming a handle section with a diameter of 0.937 inches;

ii. forming a barrel section comprising a diameter of less than 1.50 inches; and iii. forming a taper section between the handle section and the barrel section, the taper section having six discrete zones that each have a different maximum diameter, wherein the tapered section is formed such that the taper section tapers from the diameter of less than 1.50 inches at the barrel section to the diameter of 0.937 inches at the handle section, wherein the handle section and the barrel section are a same length.

10. The method of claim 9, wherein the taper section is 6 inches in length.

11. The method of claim 9, further comprising a knob, wherein an end of the handle section is coupled within the knob with a pin that runs through the knob and the end of the handle.

12. The method of claim 9, wherein the body comprises 150 g carbon fiber with 38% resin.

13. The method of claim 9, wherein the sports training device is configured to hit standard size baseballs and softballs.

* * * * *